US009067410B2

(12) United States Patent
Gallucci

(10) Patent No.: US 9,067,410 B2
(45) Date of Patent: Jun. 30, 2015

(54) METHOD FOR REALISING FLAT ARTICLES COMPRISING IMAGES

(71) Applicant: Giuseppe Gallucci, Monte Urano (Fermo) (IT)

(72) Inventor: Giuseppe Gallucci, Monte Urano (Fermo) (IT)

( * ) Notice: Subject to any disclaimer, the term of this patent is extended or adjusted under 35 U.S.C. 154(b) by 0 days.

(21) Appl. No.: 14/398,927

(22) PCT Filed: May 6, 2013

(86) PCT No.: PCT/IB2013/053603
§ 371 (c)(1),
(2) Date: Nov. 4, 2014

(87) PCT Pub. No.: WO2013/168070
PCT Pub. Date: Nov. 14, 2013

(65) Prior Publication Data

US 2015/0138262 A1 May 21, 2015

(30) Foreign Application Priority Data

May 7, 2012 (IT) ..... BO2012A0247

(51) Int. Cl.
*B41J 2/045* (2006.01)

(52) U.S. Cl.
CPC ..... *B41J 2/04501* (2013.01)

(58) Field of Classification Search
USPC ..... 700/135, 131; 358/453, 449; 347/115, 347/119
See application file for complete search history.

(56) References Cited

U.S. PATENT DOCUMENTS

| | | | | |
|---|---|---|---|---|
| 6,434,444 | B2 * | 8/2002 | Herman, Jr. | 700/135 |
| 2004/0114125 | A1 | 6/2004 | Kaiser et al. | |
| 2005/0012961 | A1 | 1/2005 | Holt | |
| 2007/0064278 | A1 * | 3/2007 | Sugimoto | 358/453 |
| 2009/0009820 | A1 * | 1/2009 | Fukui | 358/449 |
| 2009/0213428 | A1 | 8/2009 | Klippenstein | |
| 2010/0268373 | A1 | 10/2010 | Tremoureux et al. | |

FOREIGN PATENT DOCUMENTS

GB 2170934 A 8/1986

* cited by examiner

*Primary Examiner* — Lam Nguyen
(74) *Attorney, Agent, or Firm* — R. Neil Sudol; Henry D. Coleman

(57) ABSTRACT

Starting from a virtual representation of a flat-developing component, the method identifies and subsequently memorizes at least an assembly constituted by an image, a closed line containing the image, and reference crosses associated thereto; the assembly is paginated in the virtual representation such as to define an intermediate file from which a printing file is obtained with which an RIP software program can be loaded to pilot a printing machine. If the component is to be cut, with the aim of obtaining articles bearing relative images, data is obtained from the intermediate file for managing a cutting machine which cuts the component along the closed line.

5 Claims, 12 Drawing Sheets

FIG. 8
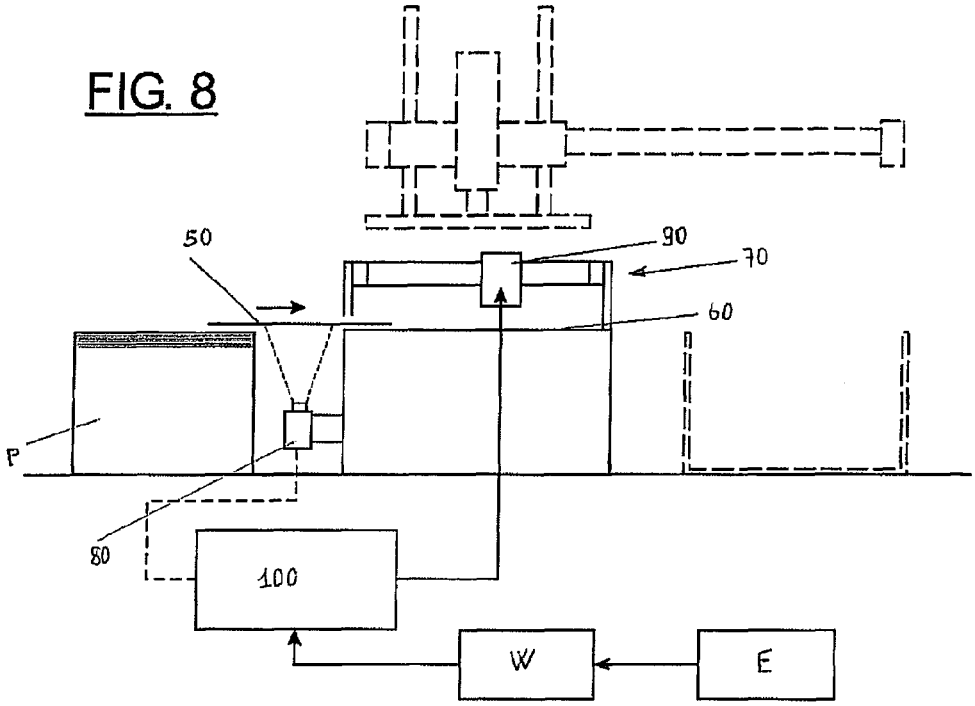
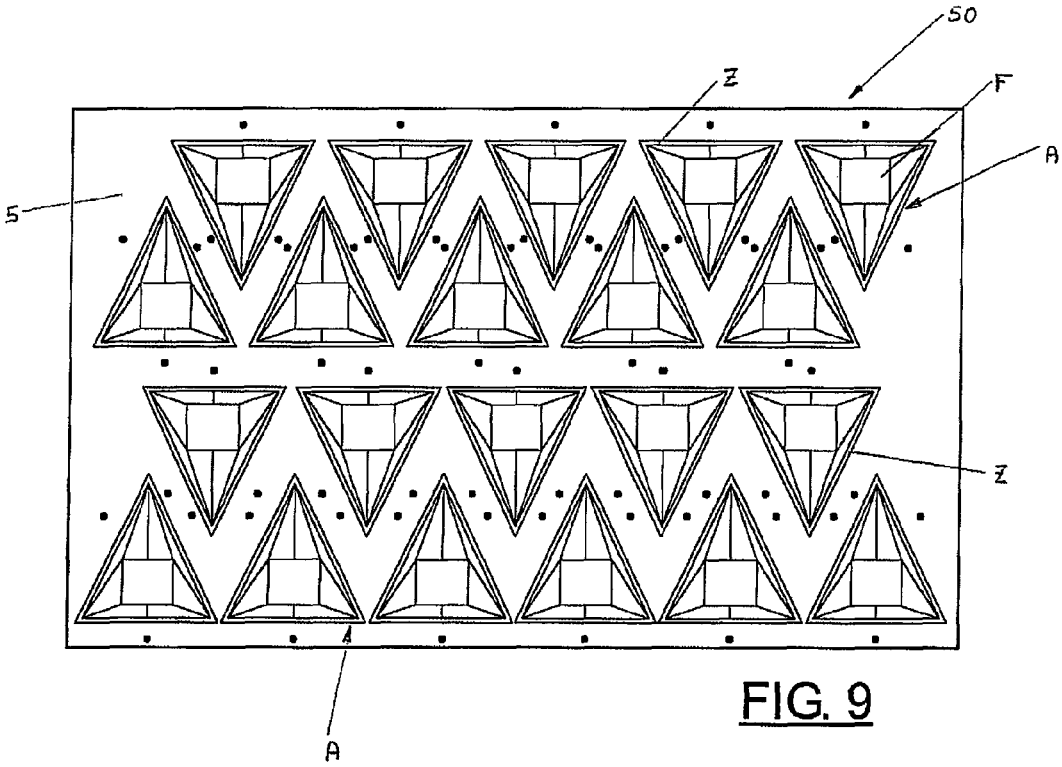
FIG. 9

METHOD FOR REALISING FLAT ARTICLES COMPRISING IMAGES

FIELD OF THE INVENTION

The present invention relates to the production of flat printed articles, in particular destined for commercial communication, realised starting from a sheet, for example made of a paper material.

DESCRIPTION OF THE PRIOR ART

These articles for example can be used for realizing display cases, banners, signs, signals etc.

At present the flat articles in question are obtained by using the following processes described with the aid of FIGS. 1 and 2.

At first the following are needed: an electronic processor (referred-to also as a computer in the following), one or more files containing: the images to be cut out; one or more sheets, made for example of cardboard, on which the images are to be printed, with the aim of then cutting them to obtain the finished article; a printer (Q) for printing the images (I) on the sheet, and a cutting machine for cutting out each printed image from the rest of the sheet.

The cutting machine is commonly known by the expression "cutting plotter" (T*) and the modes of use are known and therefore not described herein.

By use of special and known programs for computers, the virtual image (P*) of the sheet (P) to be cut is virtually subdivided into a plurality of boxes (S), identical to and separate from one another by an ideal grid.

In practice, the user must have available a preset chart for the printing layout, which chart will be termed a pre-set layout for the sake of simplicity, which must refer to a precise type of sheet, and must take account both of the dimensions and the material of which it was made.

In practice, for each type of sheet the operator has a respective pre-set layout which establishes the constrained the paginating of the image on the sheet will have (i.e. the effective print layout).

Thereafter, the operator virtually inserts copies of the images (I) in the various virtual boxes (S) (see FIG. 1), such as to define the effective print layout.

For each boxed image, the operator realizes a border (E) which represents the path the cutting plotter blade (T*) will follow around the printed image when cutting.

This border will, in the following, also be termed the cutting path (E).

The above pre-set layout is, clearly, such that each box (S) has larger dimensions than the cutting pathway destined to be circumscribed.

Therefore both an image (I) and a relative cutting pathway (E) can be associated to each box.

At this point, a first file is created ($I_1, I_2, \ldots, I_n$) with the information relating to the reciprocal correspondence between the boxes (S) and images (I) and a second file ($E_1, E_2, \ldots, E_n$) with the information relative to the reciprocal correspondence between boxes (S) and cutting paths (E).

The first and the second file ($I_1, I_2, \ldots, I_n$) ($E_1, E_2, \ldots, E_n$), together with the files of the above-described image, are uploaded into an RIP software (Raster Image Processor, i.e. a rasterimage processor), widely known in the sector, which creates a printing file (Y1) readable by the printer, and containing all the instructions relative to the printing of the images on the sheet, and a cutting file ($Y_2$) readable by the cutting plotter, and comprising all the instructions relating to the paths which will have to be followed on the sheet by the blade of the cutting plotter.

Following receiving the printing file ($Y_1$), as shown in FIG. 2, the printer (Q) prints all the images on the sheet (P) in the desired positions; following this, the printed sheet is passed on to the cutting plotter (T*) which, following the receiving of the cutting file ($Y_2$), appropriately cuts all the images such as to obtain the desired articles (see FIG. 2).

The known process exhibits some drawbacks.

Primarily, it produces a large quantity of waste trimming because every cutting path and therefore every image is inserted from a box of a predetermined shape, for example square, and there are cases in which, due for example to the irregular shape of the image to be trimmed, it is necessary to use boxes of considerable dimensions even through the surface of the images is much smaller.

Secondly, this is a process which uses a considerable machine time, in particular at the moment when the RIP software has to process at least three very large files: the above-mentioned first file ($I_1, I_2, \ldots, I_n$), the second file ($E_1, E_2, \ldots, E_n$) and the file with the original images.

Further these two drawbacks are exacerbated in the frequent case in which the images to be printed on sheets of a given material are not all identical, for example because they are provided by different subjects who have commissioned various articles of the operators in the sector who carry out the above-explained process.

Even if able to regulate the dimension of the boxes (S), it will be necessary to choose between the two cases.

If different images were to be cut from the same sheet, or in any case using the same printing layout, it would be necessary to adjust the dimensions of all the boxes to the cutting path of the largest dimensions among the various images to be cut, with a consequent further increase in waste.

Alternatively it would be necessary to define a printing layout and a layout of the cutting paths for each image, even if the sheets to be used are of the same type, with a consequent multiplication of the time used by the operator and the RIP software for carrying out the work.

One of more small crosses can be associated, as is usual in the sector, to the various images and pathways, for identifying the exact position internally of the box with the purpose of correct alignment; this can be done in a way that will be explained in the following.

The cutting plotter comprises means for detecting the position of the crosses printed on the sheet, with the aim of comparing this position with the position established during production of the printing layout and verifying if there have been deformations during the printing; on the basis of this verification, the cutting pathway can be adapted to the eventual deformations, thanks to the fact that it is also associated to respective virtual crosses the position of which in the virtual layout is the same as the crosses associated to the images.

Further, the positions of all the crosses associated to the images, which herein can be termed "reference crosses" and all the crosses of the cutting pathways (which can be termed "cutting crosses") are necessarily linked to the specific printing layout created and can never be used in future layouts also in a case in which a future order is to be produced which comprises the same images but, for example, in a different scale or to be inserted in a layout which also comprises different images and so on.

SUMMARY OF THE INVENTION

The aim of the invention is to provide a method for realising flat articles comprising images such as to obviate the drawbacks of the prior art.

A further aim of the invention is to provide a method which apart from satisfying the preceding aim enables obtaining the flat articles starting from flat-developing components of any nature, as long as it is printable material.

A still further aim of the invention is to provide a method which apart from satisfying the preceding aims enables loading, in the RIP software (Raster Image Processor) only the printing file legible by a printing machine.

The above aims are obtained according to the contents of the claims.

BRIEF DESCRIPTION OF THE DRAWINGS

Further characteristics and advantages of the invention will emerge from the accompanying tables of drawings, in which:

FIG. 8 is a lateral schematic view of a machine destined to cut the images from the panel along pre-weakened lines;

FIG. 9 is a plan view in larger scale than the preceding figure, of the panel with the images bordered by the pre-weakened lines;

DESCRIPTION OF PREFERRED EMBODIMENTS

With reference to FIGS. 3-9, F1 denotes an image file, containing all the images F that a user intends to print on a panel 10 (e.g. cardboard), with the aim of subsequently working thereon such as to obtain, by cutting, articles A on which the relative images F are printed; for the sake of simplicity, a single image of the file has been considered, but it is understood that the images contained therein can be in any number or different from one another, or identical in groups.

A closed line T corresponds to each image F, which closed line T circumscribes the image itself: this is the cutting pathway the profile of which is the one of the article A on which the image F is to be printed.

Together with the cutting pathway T, the references C are introduced (known as reference crosses in the sector): these are consequently associated to the image F and not the printing layout as known in the prior art.

A file F2 is then created containing the images F with relative cutting pathways T and relative crosses C.

The file F2 is transmitted and memorised to and in an electronic processor E and to which the virtual representations 10A of cardboard panels 10, of various sizes and of determined materials, stacked in stores M1, M2 . . . M12 are sent.

In the description, explicit reference is made, by way of example, to cardboard panels; the method of the invention is for obtaining flat articles starting from flat-developing non-rigid printable components, for example components based on threads, textiles, plastic elements, sheets, etc.

The electronic processor performs, on the virtual representation 10A of the panel 10 (cardboard), a grouping of a plurality of assemblies (assembly being taken to mean an image F with the corresponding cutting pathway T and the relative crosses C) in respective positions and with respective rotations with respect to the virtual representation 10A of the sheet 10, such as to define an optimal pagination H of the assemblies on the panel such as to minimize the surface thereof not circumscribed by the cutting pathways and such that the distance between two cutting pathways T is identical to or less than a predetermined value.

Figure 1:
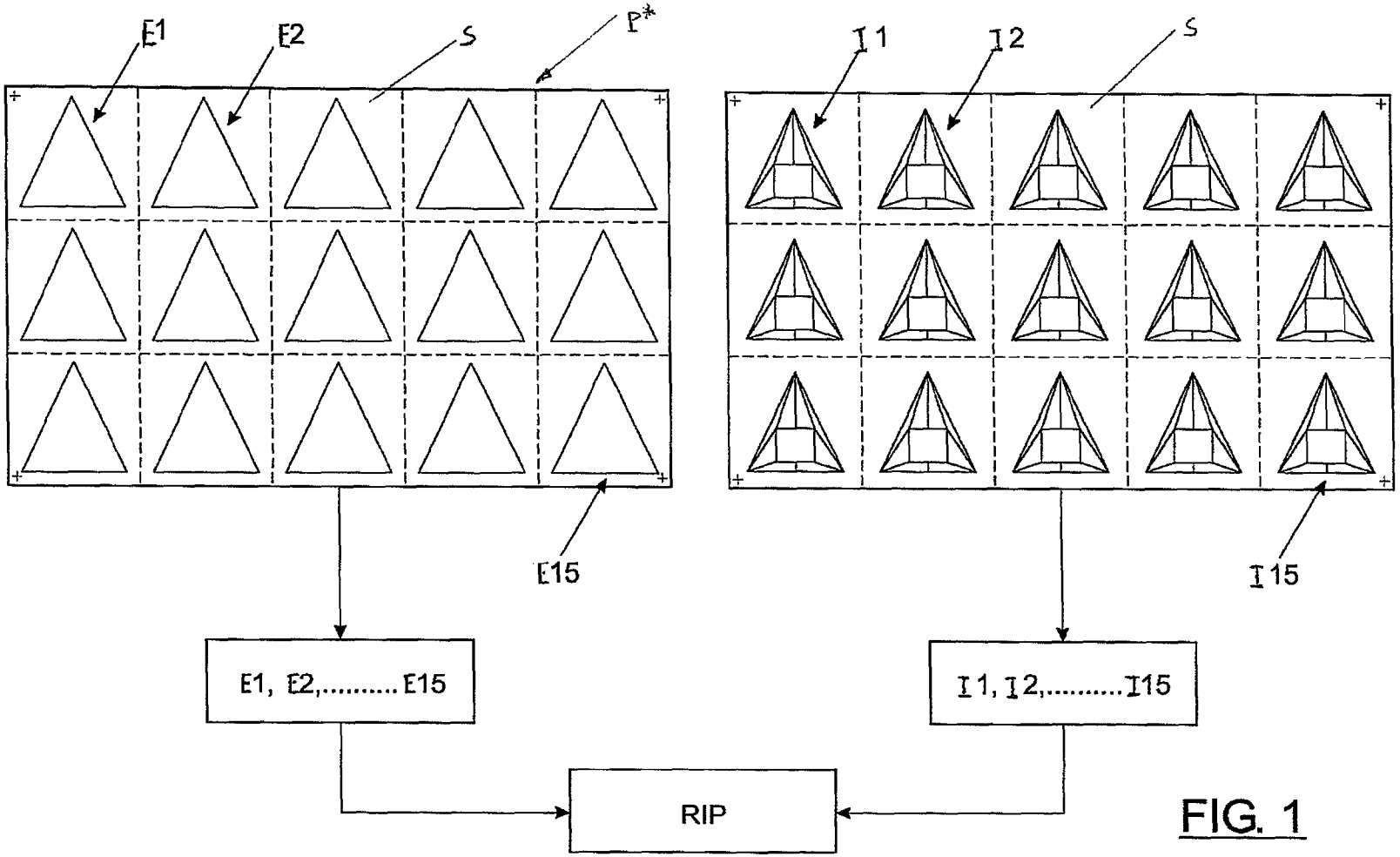
FIGS. 1, 2, mentioned in the preamble, illustrate the most significant aspects of the prior art.
Figure 2:
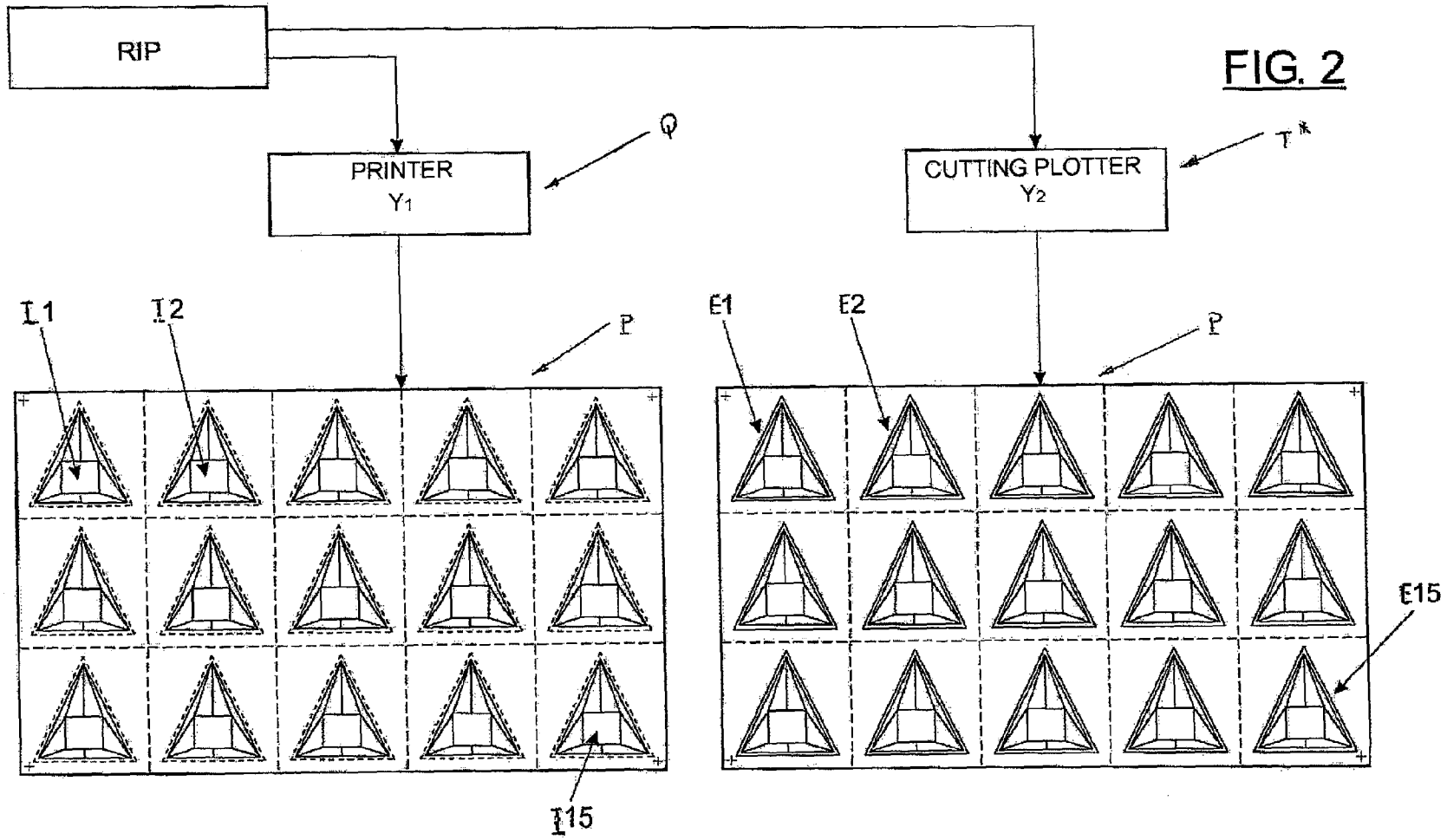
Figure 3:
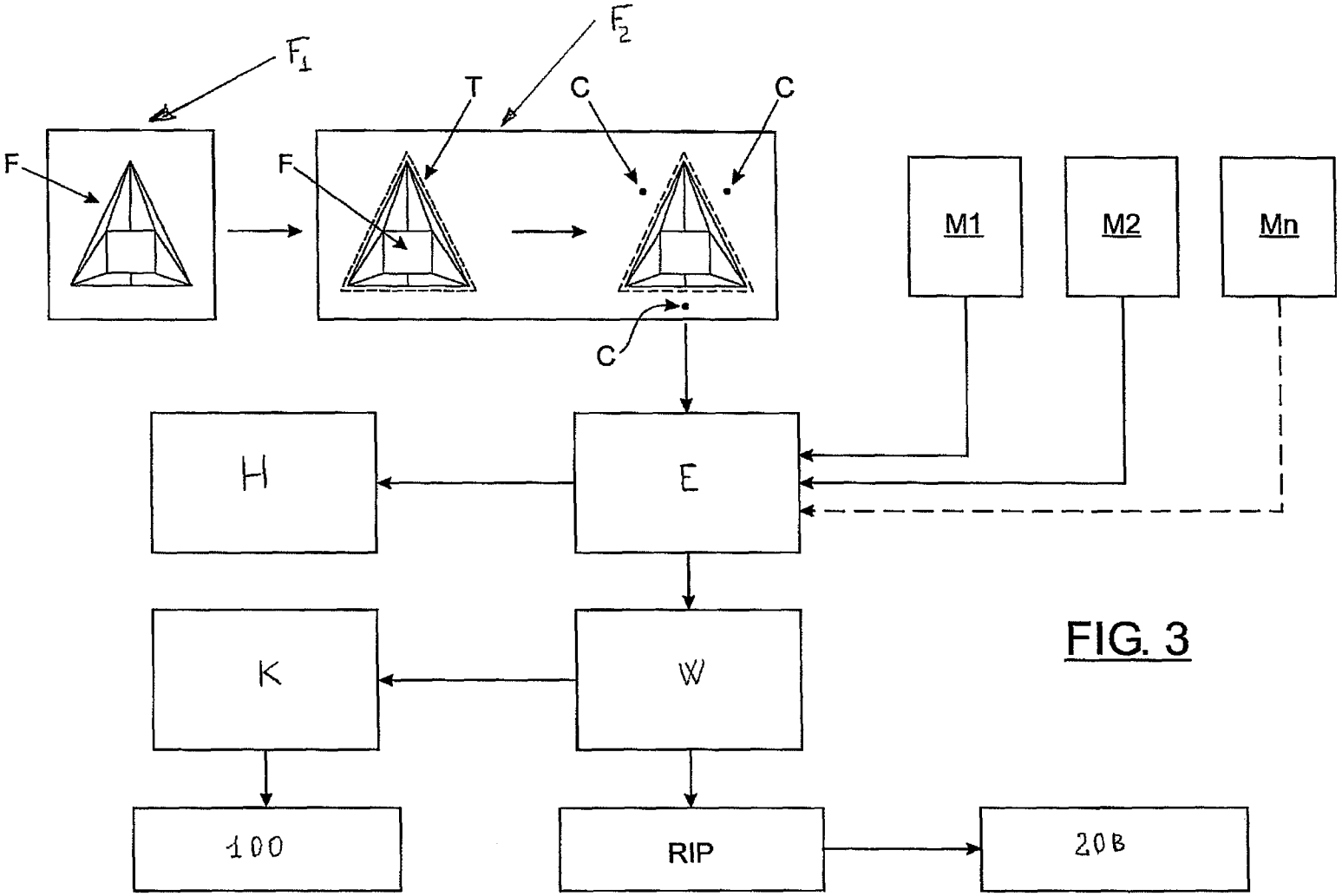
FIG. 3 schematically illustrate, in blocks, a first embodiment of the method of the present invention.
Figure 4:
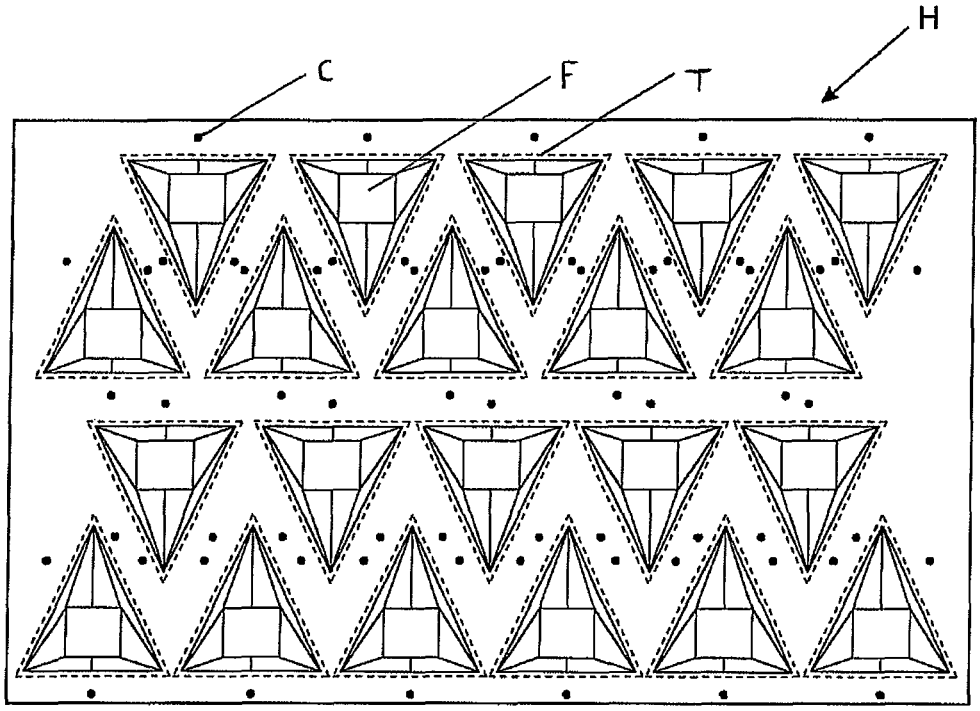
FIGS. 4, 5, 6 are detailed illustrations, by way of example, of blocks H, K and W of FIG. 3.

The pagination H is illustrated in FIG. 4.

To obtain the pagination it is sufficient to specify the position of the centre of the image and the rotation thereof, considering the coordinates with respect to a Cartesian reference system with an origin coinciding with the origin of the sheet on which the print is to be made.

Figure 6:
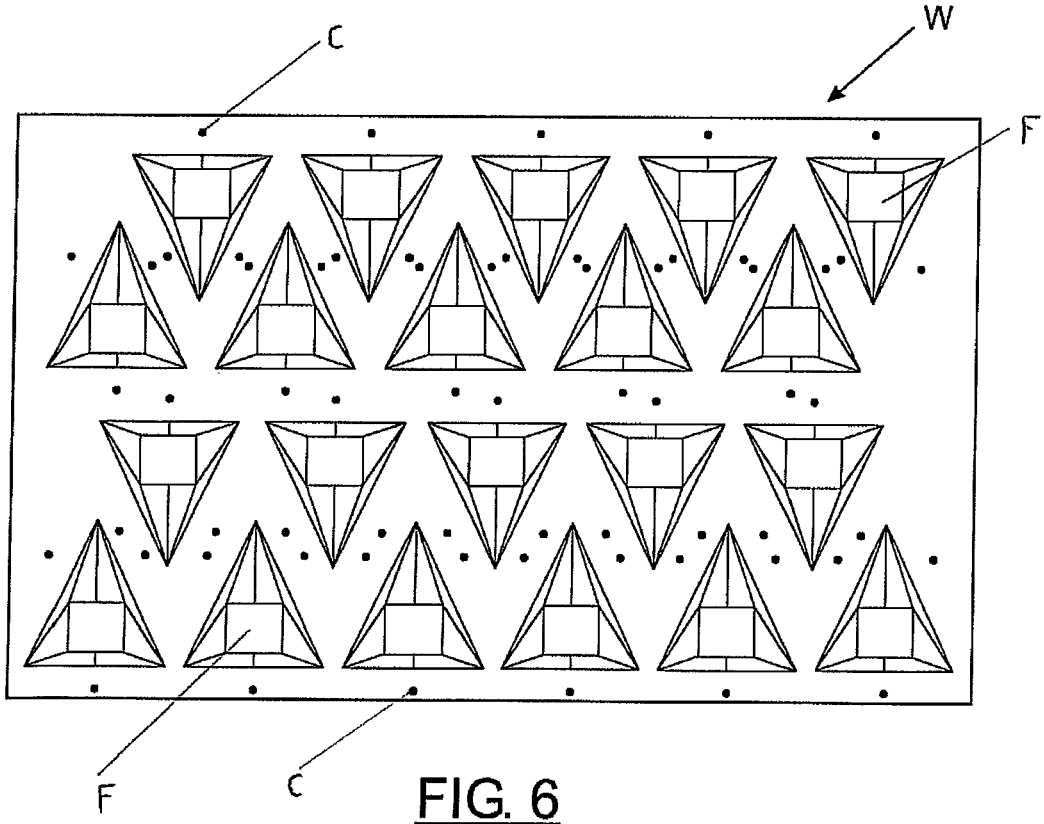

The processor E generates an interchange file W in which both the positions of the images F internally of the printing layout and the position of the crosses C associated to the images are reported: see FIG. 6 for this.

Figure 5:
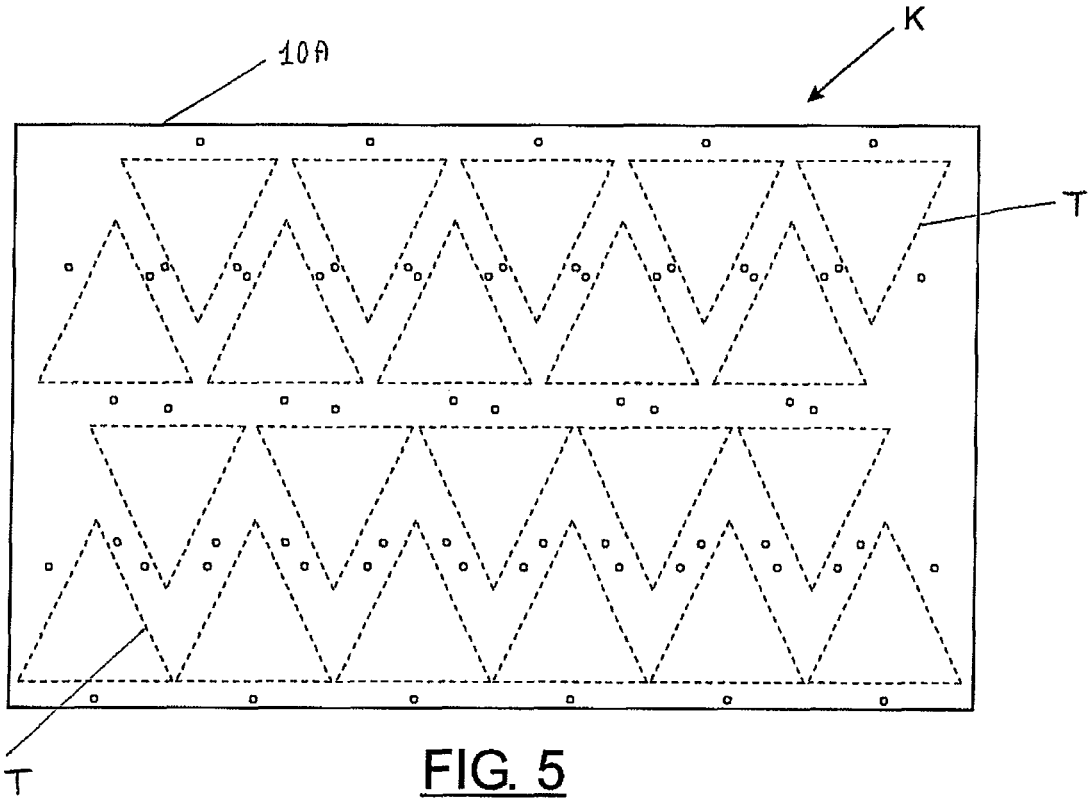

At this point it is not necessary to generate the cutting file as since the positions of the single images are known for each thereof, the relative cutting pathways are also known: see block K for this, and the representation of the cutting pathways T (with the reference crosses C) shown in FIG. 5.

Figure 7:
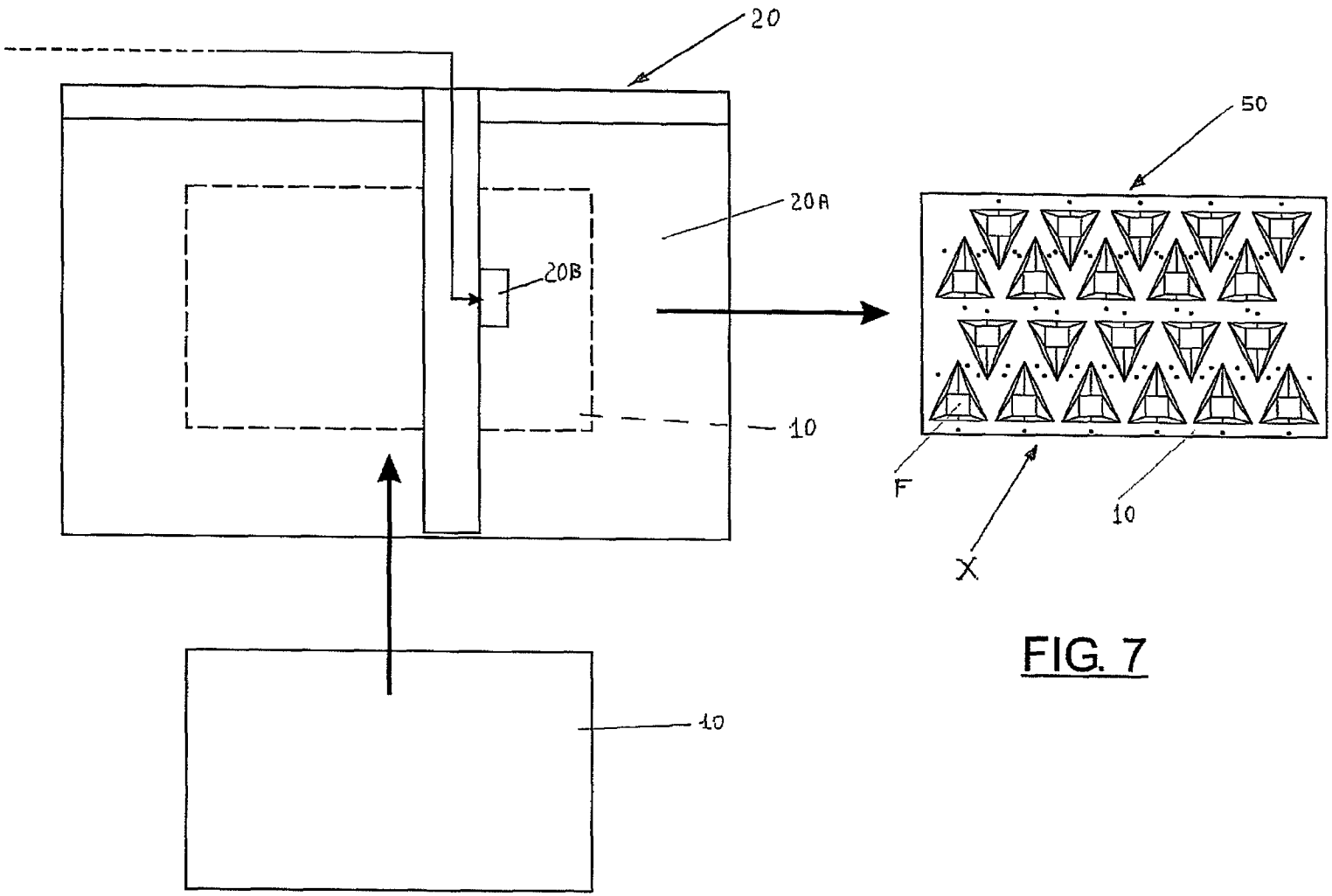
FIG. 7 is a schematic plan view of the machine for printing images on a panel.

The interchange file W is memorised and, when needed, loaded into an RIP software program (Raster Image Processor) of known type which processes only the printing layout: in other terms the RIP is the driver of a printer 20 (see FIG. 7).

First the panel 10 (corresponding to the virtual image 10A) of determined dimensions and predetermined materials is located on the work plane 20A of the printer and, following this, the positioning of the panel is detected; this enables the printing head 20B, managed by the RIP, to print the images F on the sheet 10: see in this regard the box X of FIG. 7 where 50 denotes the printed panel 10, i.e. the panel on which the images F are reproduced.

The panels 50 are stored, for example stacked in a stack P (FIG. 8).

The head panel 50 of the stack P is transferred, in a known way, onto a work plane 60 of a cutting machine 70 (FIG. 8) (see for example document WO 2011/045729); during this transfer a reader 80 detects the mutual positioning of the images F in the printed panel 50, as well as the positioning of the crosses C associated to the image.

The reader 80 is connected to a control card 100 in which the information relating to the interchange file W required for carrying out the cutting of the panel 50 is memorised.

Further, the control card 100 compares the position of the crosses C present on the panel 50 (and read by the reader 80) and compares them with the positions stored in the file W; from this comparison the deformation introduced by the printing can be estimated and consequently it can be corrected by means of a controlled deformation system of the cutting pathways T.

The cutting plotter 90 of the cutting machine 70, controlled by the control card 100, intervenes to cut (for example using pre-weakened lines Z) the panel 50 along the cutting pathway T.

In this way a series of articles A are obtained from the panel 50 (see FIG. 9) and a waste cutting 5.

Waste is considerably reduced with the disclosed method, i.e. use of materials (the panels) is optimized; further, the fact of associating the relative cutting pathway T, with the relative reference crosses, to each image F, enables repeated reusing of the data relating to the same assembly (i.e. image, cutting pathway, crosses) to define groups of assemblies, identical in the determination of the printing file, and reusing the data in the managing of the production processes connected to the printing.

Significantly the RIP software program only creates the printing layout and, thereafter, the physical printing of the layout; no generating of the cutting pathways is required of the RIP.

Figure 10:
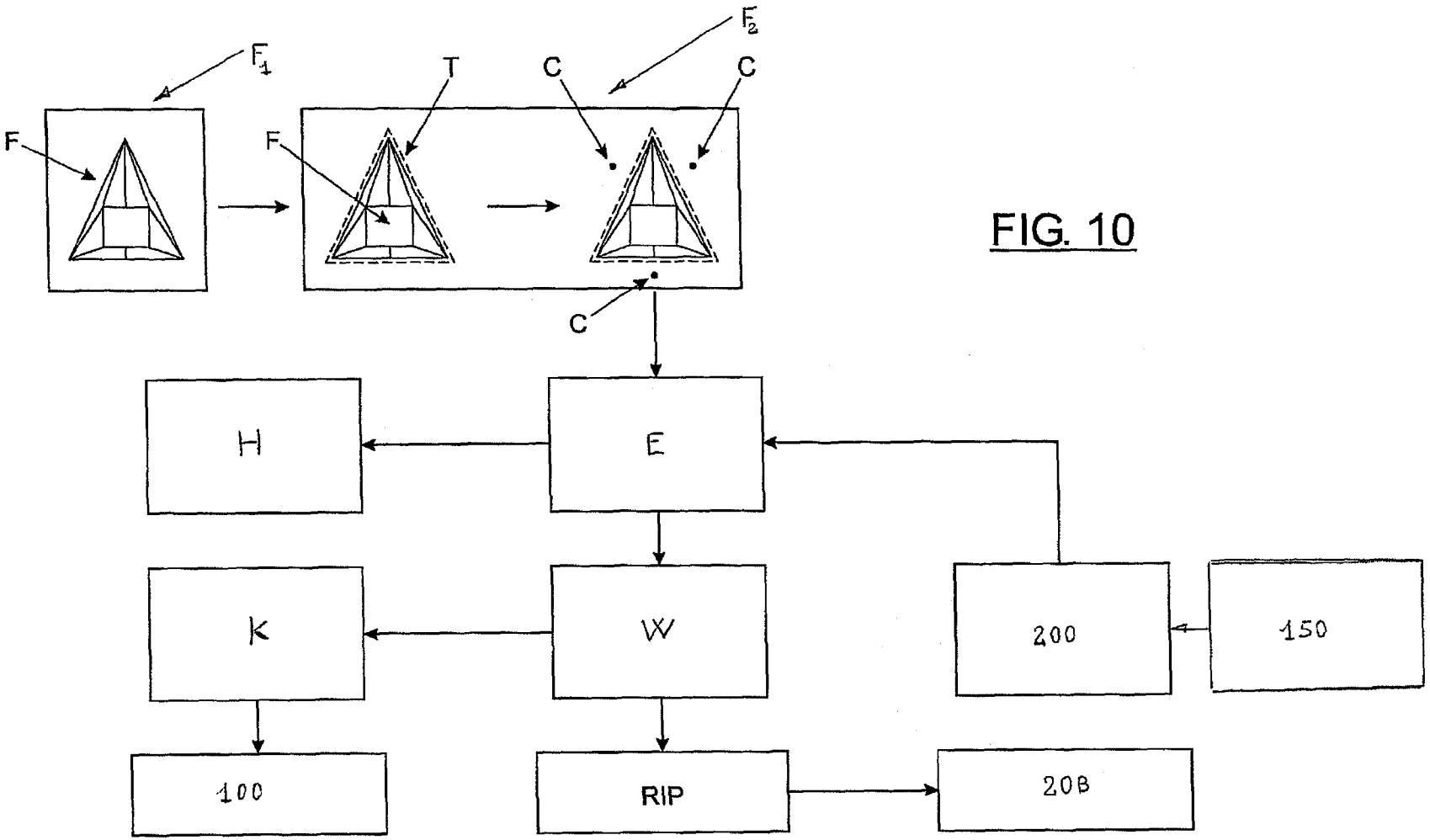
FIG. 10 schematically illustrates, in blocks, a second embodiment of the method of the invention.
Figure 11:
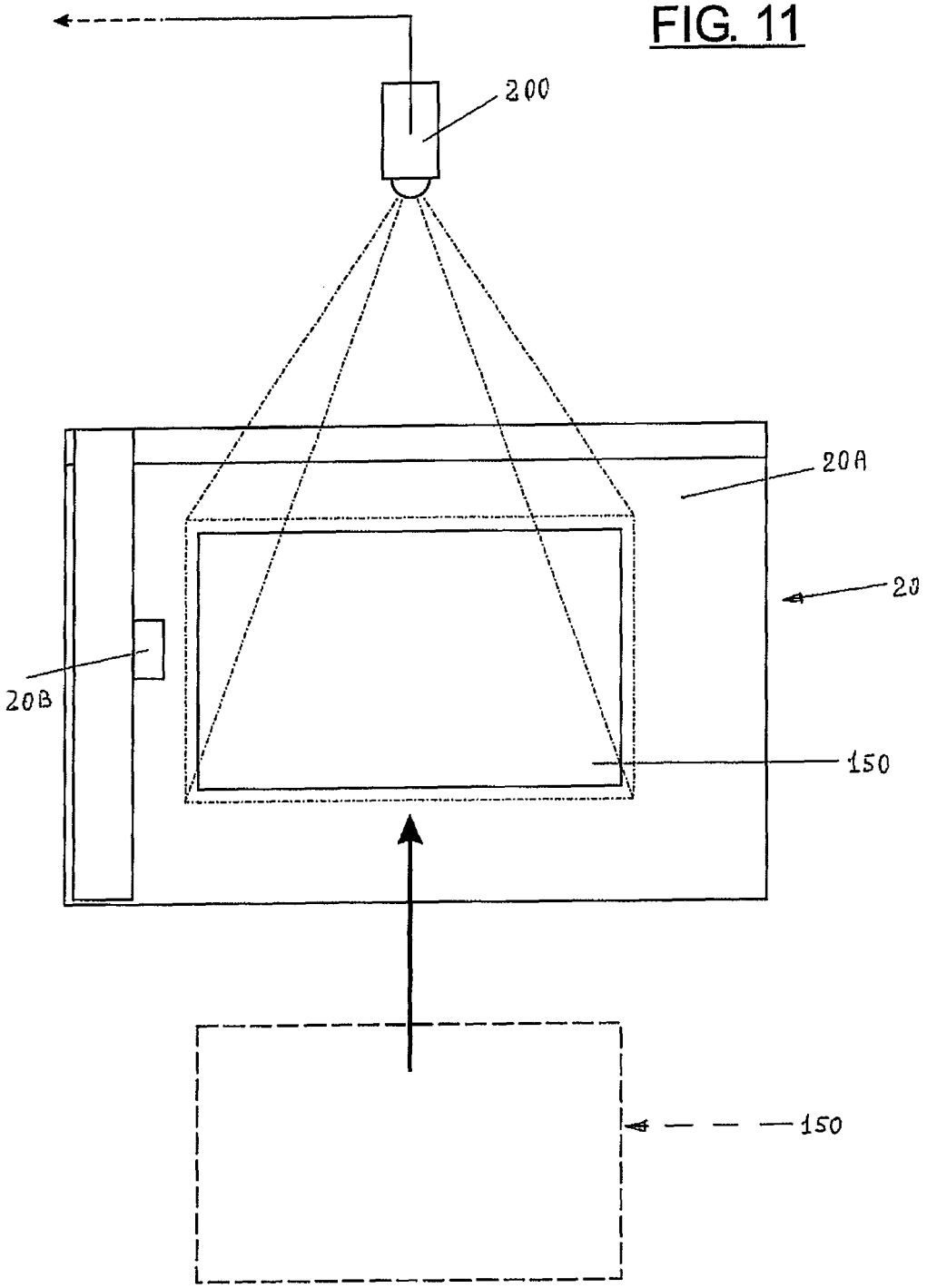
FIG. 11 schematically illustrates the acquiring of the dimensions and the positioning of a panel located on a printer.

In the embodiment of FIGS. 10, 11 the virtual image of a panel 150 located on the operating plane 20A of the printer 20 is sent to the electronic processor E.

In detail, the operator positions the panel 150 on the plane 20A; a reader 200 detects the positioning and dimensions thereof, and transmits the relative data to the processor E that is thereforeable to define the virtual image mentioned herein above.

The subsequent operations are similar to those considered with reference to FIGS. 3-9.

Figure 12:
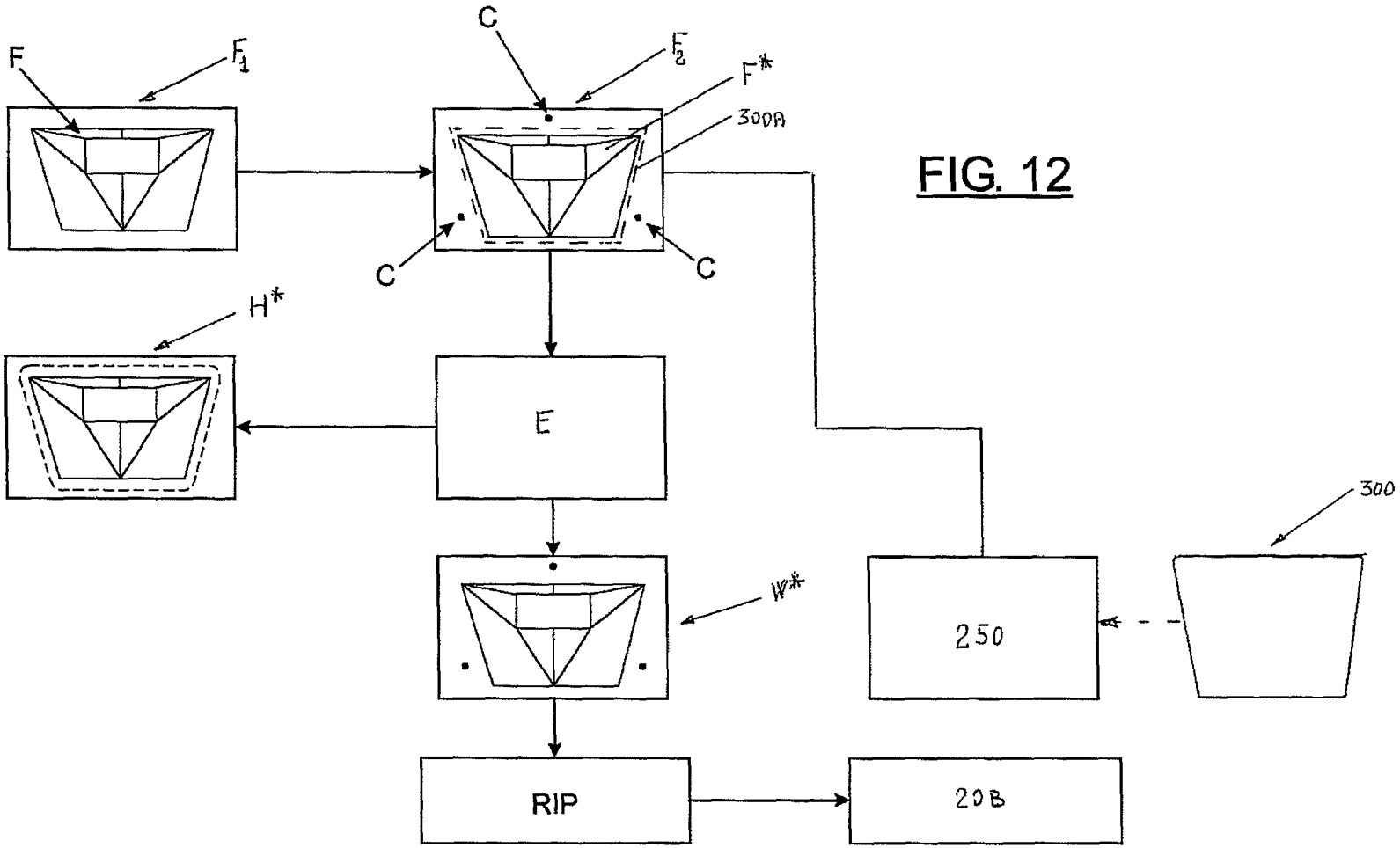
FIG. 12 is a schematic illustration, in blocks, of a third embodiment of the method of the present invention.
Figure 13:
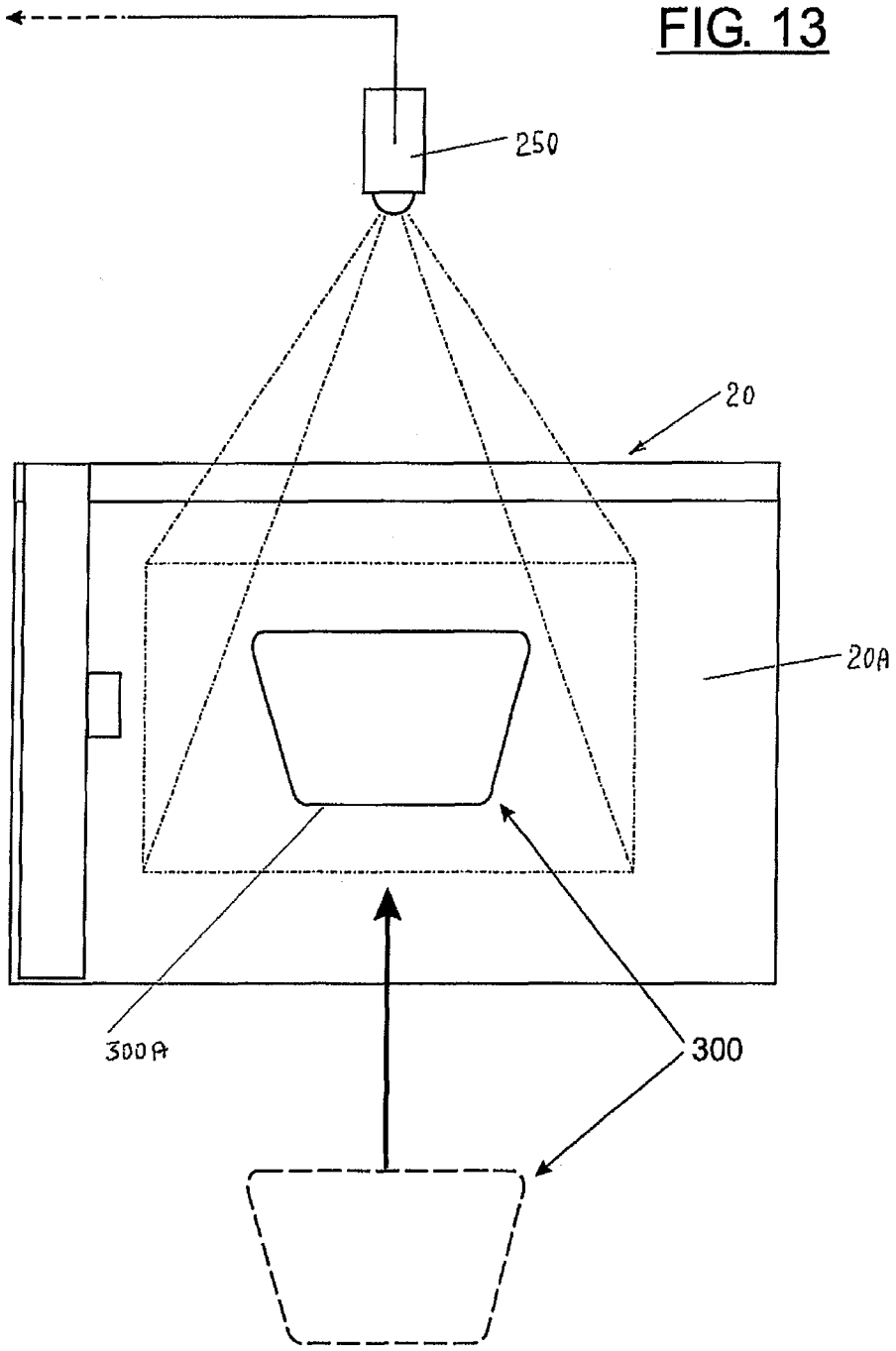
FIG. 13 schematically illustrates the acquiring of the dimensions and the positioning of an article located on a printer.
Figure 14:
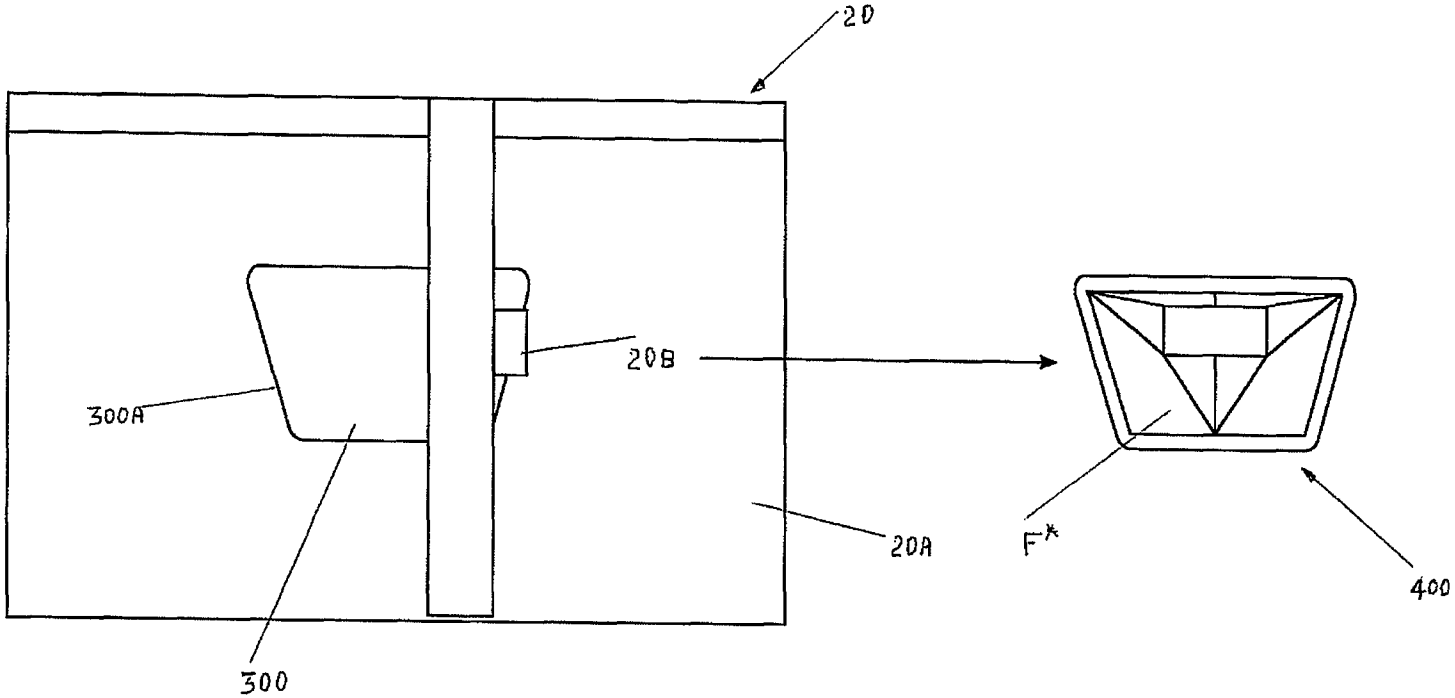
FIG. 14 schematically illustrates the printer as well as the article on which a predetermined image has been printed.

In the embodiment of FIGS. 12-14, an article 300 is located on the work plane 20A of the printer 20 (FIG. 13), on which article 300 at least an image F* is to be printed; this article must not be cut.

A reader 250 detects the positioning and the profile of the article, the border 300A of which is considered as a cutting pathway to be considered "virtual" as it will not give rise to any cutting.

The image to be printed on the article has been denoted by F*, and F1 denotes the relative image file (at least an image as evidenced).

To define the file F2, it is necessary to associate to the image F* the virtual cutting pathway as identified by the border 300A of the article 300.

The processor E carries out the correct pagination of the image F* in the pathway 300A (see block H*) and defines the intermediate file W* (see the block); this is transmitted to the RIP which processes and then commands the printing head 20B which prints the image F* on the article located on the work plane 20A of the printer 20; in this way a printed article 400 is obtained, constituted by the starting article 300 on which the image F* had been printed (FIG. 14).

Apart from the advantages already mentioned, the method of the invention enables printing images on flat components of any profile located on the work plane of the printer.

The above has been described by way of non-limiting example; any technical-functional variants of the steps of the methods are understood to fall within the protective scope of the invention as claimed in the following.

The invention claimed is:

1. A method for realising articles comprising at least an image, comprising steps of:

providing at least a component (10, 150) having a flat development realised in a printable material;

providing at least a first file (F1) of images comprising at least an image (F) to be printed;

providing at least an electronic processor (E);

providing a printing machine (20) for printing on the component (10, 150), activatable via the electronic processor (E);

and characterised in that it comprises steps of:

positioning the component (10, 150) on a work plane (20A) of the printing machine (20);

providing optical means (200, 250) above the work plane (20A), and connected to the processor (E), and using the optical means (200, 250) for detecting the positioning of the component (10, 150) on the work plane (20A) and the dimensions of the component (10, 150);

on the basis of the positioning and dimensions of the component (10, 150) detected by the optical means (200, 250), processing a virtual representation (10A) of the component (10, 150) by means of the processor (E), circumscribing the profile of the image (F) to be printed with a closed line (T) such as to define an assembly constituted by the image (F) and the closed line (T) which circumscribes the profile of the image (F);

memorising, in a second file (F2), the assembly constituted by the image (F) and the closed line (T);

performing, on the virtual representation (10A) of the component (10, 150), a pagination (H) of at least a said assembly in a respective position obtained with the aid of rotation of the assembly with respect to the virtual representation of the component, to define an intermediate file (W);

memorising the pagination (H) of the assembly of the intermediate file (W) in a printing file readable by the printing machine (20);

using the printing machine (20), piloted by the printing file of the preceding step, in order to print the image (F) present in the assembly on the component (10, 150) according to the pagination (H) obtained; the component with the printed image of the assembly being a said article.

2. The method of claim 1, characterised in that it further comprises the step of providing a cutting machine (70) having a work plane (60) for cutting portions of component from the component, and in that it comprises, before printing, carrying out following steps for processing the intermediate file (W);

associating, to the at least an image (F) present in the first file (F1) of images, relative reference crosses (C);

circumscribing the profile of the image (F) with a closed line (T) defining a cutting pathway such as to define a assembly constituted by the image (F), the reference crosses (C) associated thereto and the closed line (T) defining the cutting pathway which circumscribes the profile of the image (F);

memorising in a second file (F2) the assembly constituted by the image (F), the reference crosses (C) and the closed line (T) defining the cutting pathway;

performing, on the virtual representation (10A) of the component (10, 150), a grouping of a plurality of the assemblies in respective positions and with respective rotations with respect to the virtual representation of the component, in order to obtain a pagination (H) of the assemblies on the component such as to minimise the surface thereof not circumscribed by cutting pathways and such that the reciprocal distance between any two cutting pathways is equal to or less than a predetermined amount, such as to define the intermediate file (W);

memorising the pagination (H) of the assemblies of the intermediate file (W) in a printing file readable by the printing machine (20);

using the printing machine (20), piloted by the printing file of the preceding step, in order to print the images (F) and the reference crosses (C) present on the component according to the pagination (H) obtained;

transferring and positioning the component, with the images and the reference crosses printed thereon according to the pagination (H), on the work plane (60) of the cutting machine (70), and using the cutting machine (70) for cutting, from the component, portions thereof according to the cuffing pathways (70) deducible from the intermediate file (W), each cut portion of component containing a relative image being one of the articles.

3. The method of claim 2, characterised in that it comprises the step of providing a reader (80) above the work plane (60) of the cutting machine (70), and in that it comprises, once the component, with the images and the reference crosses printed thereon according to the pagination (H), has been positioned on the work plane (60) of the cutting machine (70) and before performing the cut, carrying out following steps:

using the reader (80) to detect the positioning of the component on the work plane (60) and the positioning of the reference crosses (C) printed thereon associated to the images (F), comparing the positions of the reference crosses (C) detected by the reader (80) with the positions of the reference crosses (C) memorised in the intermediate file (W), and verifying any differences between the positions caused by the printing process and, in a case of differences, proceeding to correct the cutting pathways (T) according to the effective positions of the crosses (C) detected by the reader (80).

4. The method of any one of the preceding claims, characterised in that the flat-developing component is constituted by a component made of a non-rigid printable material such as a textile or a cardboard.

5. The method of claim 1 or 2, wherein the steps of memorising the pagination (H) of the assemblies of the intermediate file (W) in a printing file readable by the printing machine (20) and the following printing step are realized by use of a Raster image processing program performed on the electronic processor.

* * * * *